US005815846A

United States Patent [19]

Calonge

[11] Patent Number: 5,815,846

[45] Date of Patent: Oct. 6, 1998

[54] RESISTANT HELMET ASSEMBLY

[75] Inventor: Rafael Calonge, Barcelona, Spain

[73] Assignee: Tecno-Fluidos, S.L., Barcelona, Spain

[21] Appl. No.: 753,693

[22] Filed: Nov. 27, 1996

[51] Int. Cl.[6] ..... A42B 3/00

[52] U.S. Cl. ..... 2/413; 2/425

[58] Field of Search ..... 2/411–414, 425

[56] References Cited

U.S. PATENT DOCUMENTS

| | | | |
|---|---|---|---|
| 3,668,704 | 6/1972 | Conroy et al. | 2/413 |
| 3,872,511 | 3/1975 | Nichols | 2/413 |
| 5,181,279 | 1/1993 | Ross | 2/414 |
| 5,336,703 | 8/1994 | Chen | 2/411 |

FOREIGN PATENT DOCUMENTS

| | | | |
|---|---|---|---|
| 4024957 | 2/1992 | Germany | 2/411 |
| 1355230 | 11/1987 | U.S.S.R. | 2/413 |

*Primary Examiner*—Gloria M. Hale
*Attorney, Agent, or Firm*—Malloy & Malloy, P.A.

[57] ABSTRACT

An impact resistant helmet assembly having a first material layer coupled to a second material layer so as to define a gas chamber therebetween which contains a quantity that provides impact dampening upon an impact force being applied to the helmet assembly. The helmet assembly further includes a containment layer disposed over the second material layer and structured to define a fluid chamber in which a quantity of fluid is disposed. The fluid includes a generally viscous gel structured to provide some resistance against disbursement from an impacted region of the fluid chamber to non-impacted regions of the fluid chamber, thereby further enhance the impact distribution and dampening of the impact force provided by the helmet assembly.

22 Claims, 4 Drawing Sheets

RESISTANT HELMET ASSEMBLY

BACKGROUND OF THE INVENTION

1. Field of the Invention

The present invention relates to an impact resistant helmet assembly which substantially improves the impact distribution and dampens the effects of a direct blow to the helmet surface so as to substantially protect a wearer from injury.

2. Description of the Related Art

Safety helmets are indispensable items of safety equipment for a wide variety of purposes such as riding a bicycle or motorcycle, functioning in hazardous work environments, and also for a variety of recreational sports. Generally, a helmet is structured to provide shock-absorption properties so as to protect a wearer from potentially deadly injury resulting from a direct blow to the wearer's head.

Existing helmet designs typically include a substantially rigid outer shell, with the inside of this rigid outer shell being typically lined with a combination of foam and rubber-like padding which tightly surrounds a wearer's head on an underside of the helmet surface. The materials utilized in forming such helmets usually include a deformable synthetic foam material. In the event of a direct blow to the hard outer shell of the helmet, the force of the blow is transferred to the foam and rubber-like padding surrounding the helmet assembly. Upon an impact to the helmet surface, the foam and rubber-like padding deform in a gradual manner so as to absorb a portion of the impact energy and reduce the effects of the impact upon the wearer.

In addition to merely including the foam absorption, others in the art have also sought to utilize the movement of air between various foam filed pockets. In these types of assemblies, however, the air freely moves from one pocket to another, with the only resistance to movement relating to a size of the connections between the pockets. Of course, such a restriction of flow can resist the air movement to a certain extent, however, it is often to much resistance as the air must filter down to a very narrow opening. Indeed, the force of an impact affects a helmet and the wearer in fractions of a second, and as a result, a slow funneling movement provides for uncontrolled and often to great a slow down to air movement. As such, it would be highly beneficial to provide an assembly which is structured to provide significantly increased impact dampening in a uniform and effective manner. Rather than merely permitting small controlled portions of air to move, it would be beneficial to allow a large volume of movement for a maximum force translation, the entire volume being slowed in order to maximize force translation. Specifically, only structure which permits only a small volume to disburse during impact will translate and dissipate much less force than a large volume. Furthermore, the reliance on air as a primary dampener is not as effective as would be desirable due to the generally free movement of air, even through porous foam.

Accordingly, there is still a need in the art for an improved impact absorbent helmet assembly which maximizes the impact dampening that is achieved in the short period of time it generally takes for an impact force to take effect, without substantially adding to the overall bulk and size of the helmet. Moreover, there is a need for such a helmet assembly which does not merely rely on air and known absorbent structures, but rather is structured to provide substantial increased protection over what can conventionally be achieved in a comfortable, secure and preferably snug fit.

SUMMARY OF INVENTION

The present invention is directed towards an impact resistant helmet assembly. The impact resistant helmet assembly is structured so as to dampen and better distribute the impact force of a direct blow to the helmet surface so as to substantially protect a wearer from injury.

Specifically, the impact resistant helmet assembly of the present invention, which is preferably configured to correspond a wearer's head and a desired exterior helmet configuration, includes a first material layer coupled to a second material layer. In particular, the first material layer and the second material layer are structured and disposed relative to one another so as to define a gas chamber therebetween. Moreover, the gas chamber is filled with a quantity of gas so as to provide a degree of impact dampening.

Disposed over the second material layer is a containment layer. The containment layer and the second material layer define a fluid chamber therebetween which is to be filled by a quantity of fluid. Preferably, the fluid is a generally viscous gel structured to generally resist disbursement from an impacted region of the fluid chamber to non-impacted regions of the fluid chamber. The resisted disbursement of fluid from the impacted region of the fluid chamber to the non-impacted regions of the fluid chamber provides enhanced impact distribution and dampening.

It is an object of the present invention to provide an improved impact resistant helmet assembly structured to provide improved impact distribution and thereby reduce the likelihood of injury to a wearer resulting from a direct blow to the helmet.

A further object of the present invention is to provide an improved impact resistant helmet assembly which is substantially light weight, yet is capable of withstanding substantial impacts.

Another object of the present invention is to provide an improved impact resistant helmet assembly which effectively distributes the force of an impact throughout the helmet in a substantially dampened manner.

An additional object of the present invention is to provide an improved impact resistant helmet assembly which is not substantially bulky as it utilizes resistance to fluid disbursement within the helmet to effectuate maximum impact dampening.

It is a further object of the present invention to provide an improved impact resistant helmet assembly which maximizes an effect of fluid disbursement therein.

These and other objects, features, and advantages of the present invention will become more readily apparent from the attached drawings and the detailed description of the preferred embodiments, which follows:

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
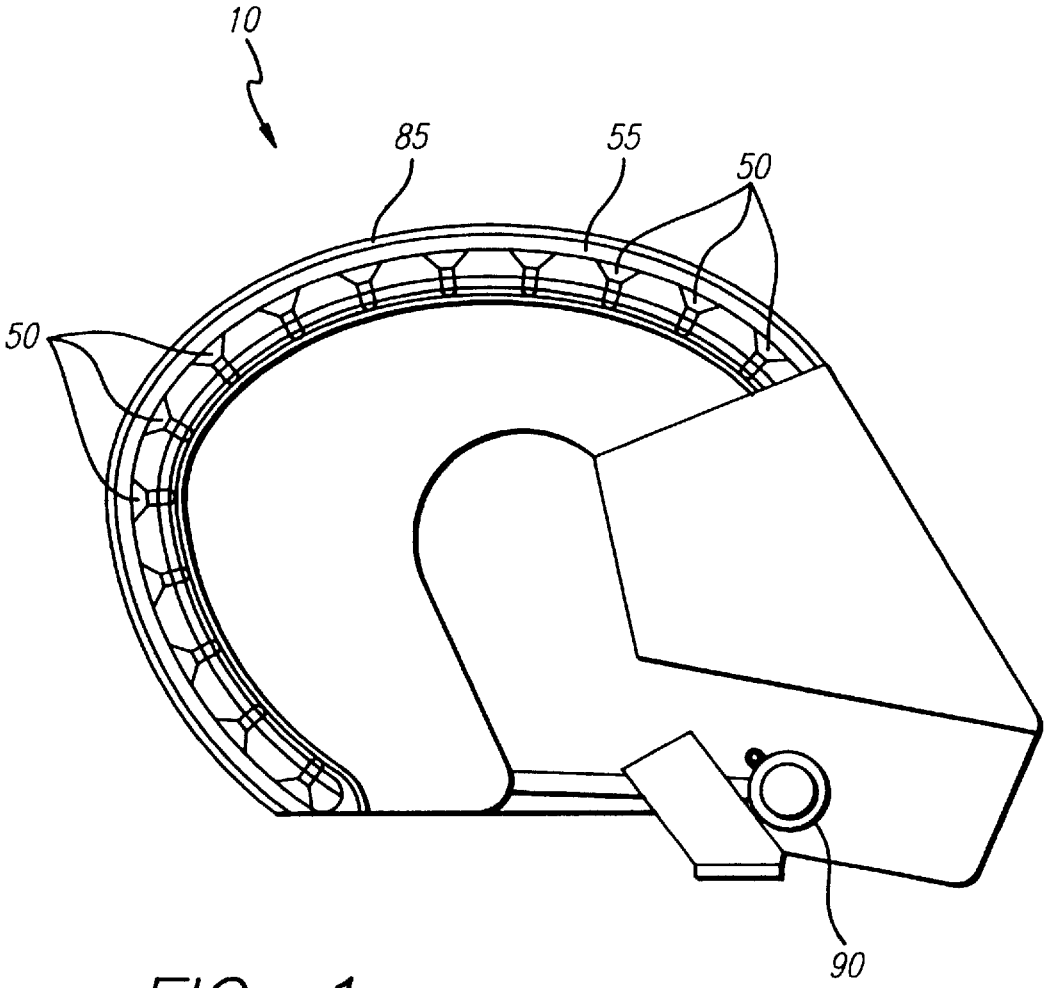
FIG. 1 is a cross-sectional side view of the impact resistant helmet assembly.
Figure 2A:
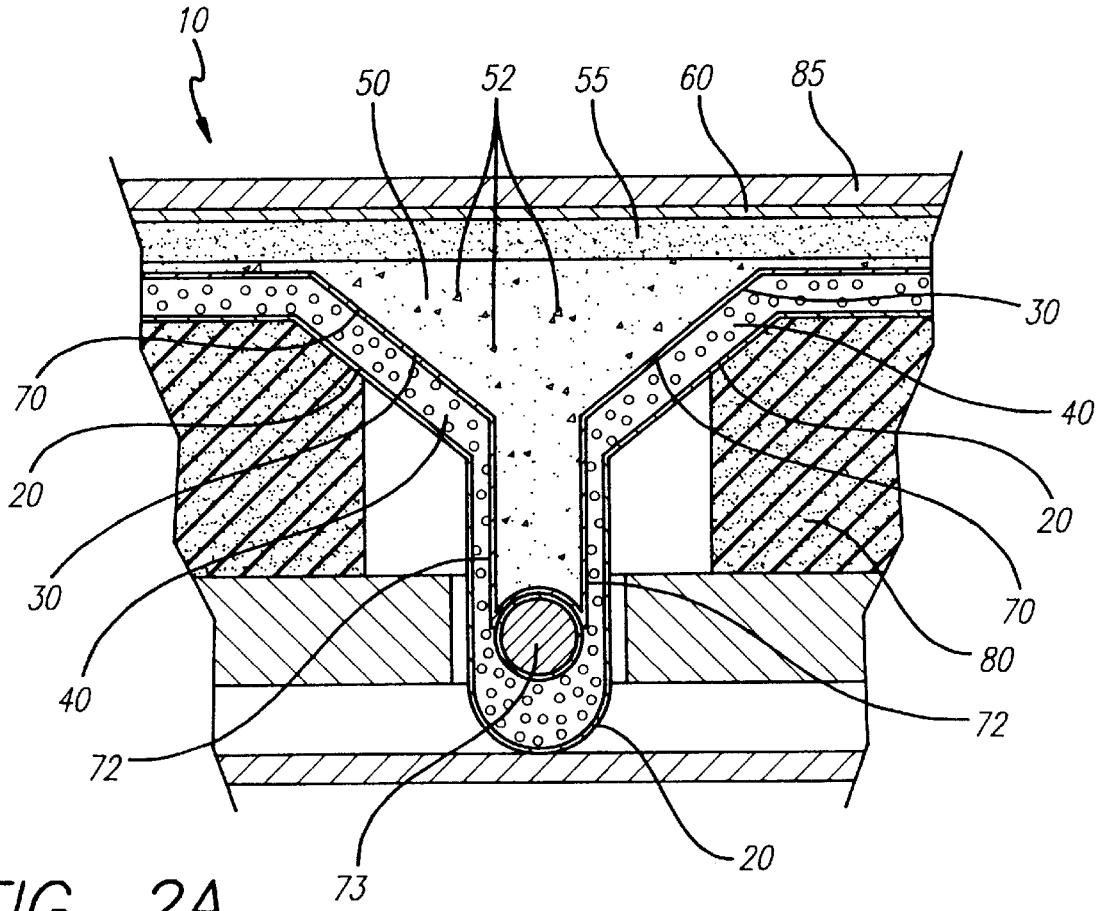
FIG. 2 is a cross-sectional detail view showing one of the non-impacted equalization pockets of the impact resistant helmet assembly.
Figure 2B:
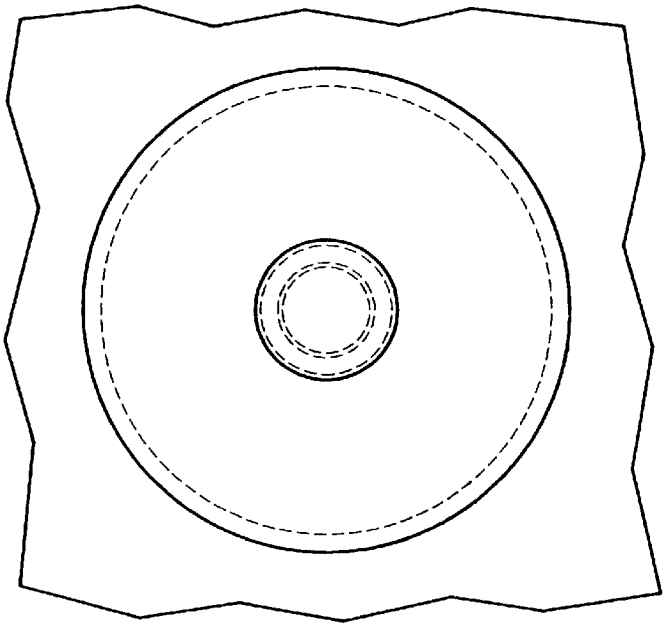
Figure 3A:
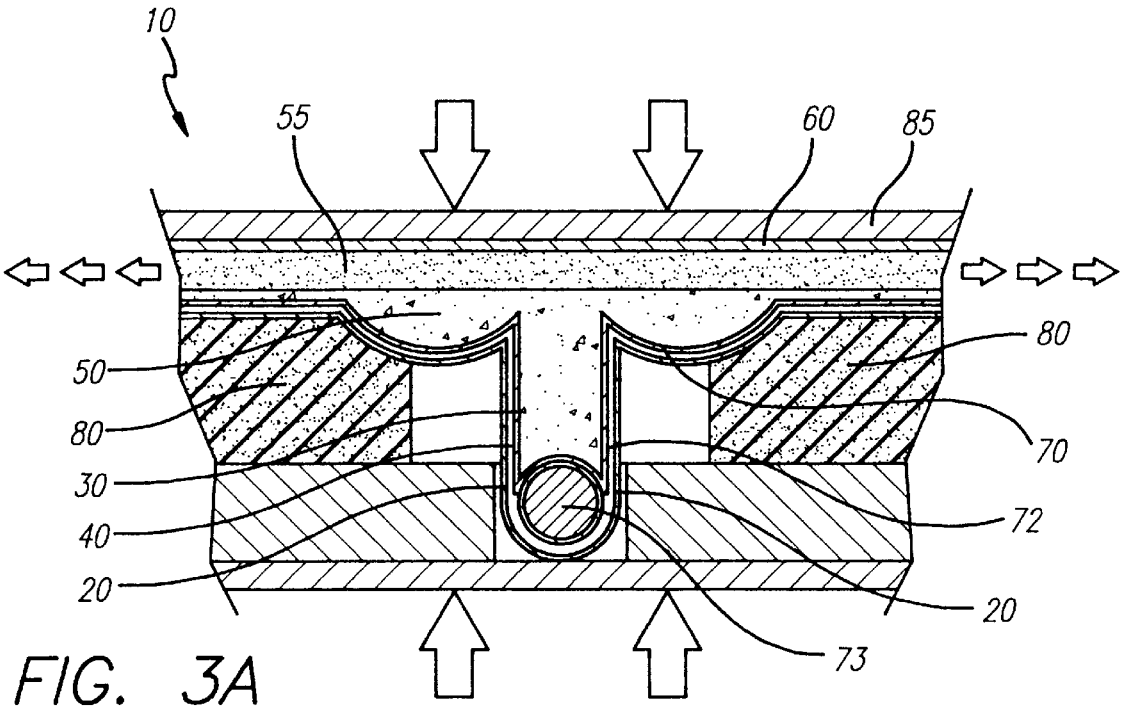
FIG. 3 is a cross-sectional detail view showing one of the equalization pockets of the impact resistant helmet shown after an impact thereupon.
Figure 3B:
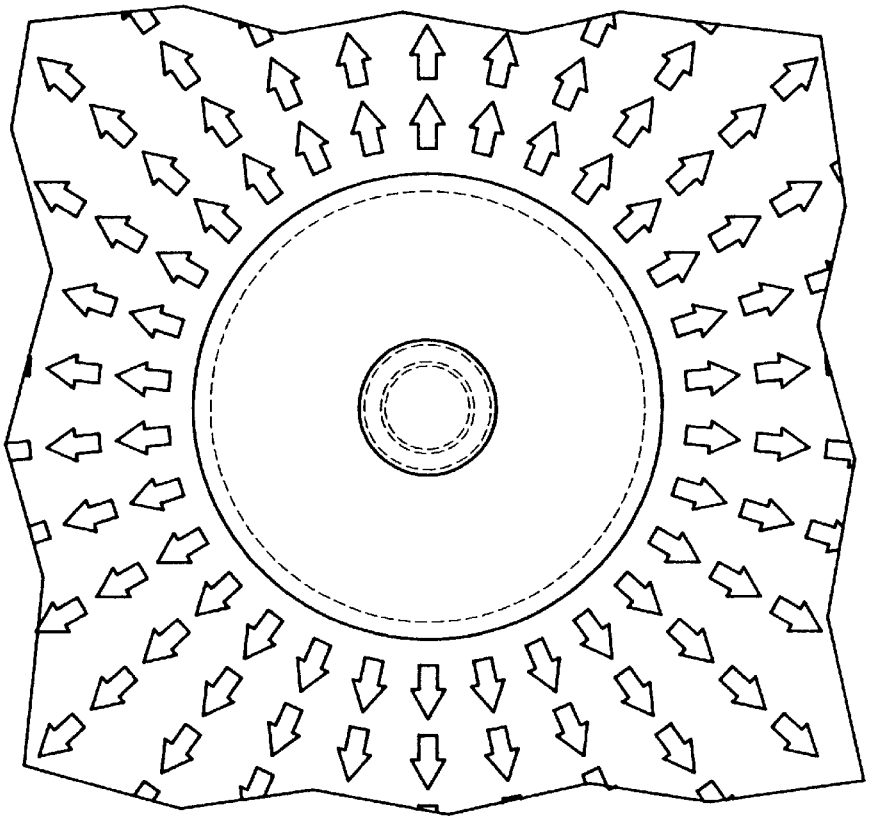
Figure 4:
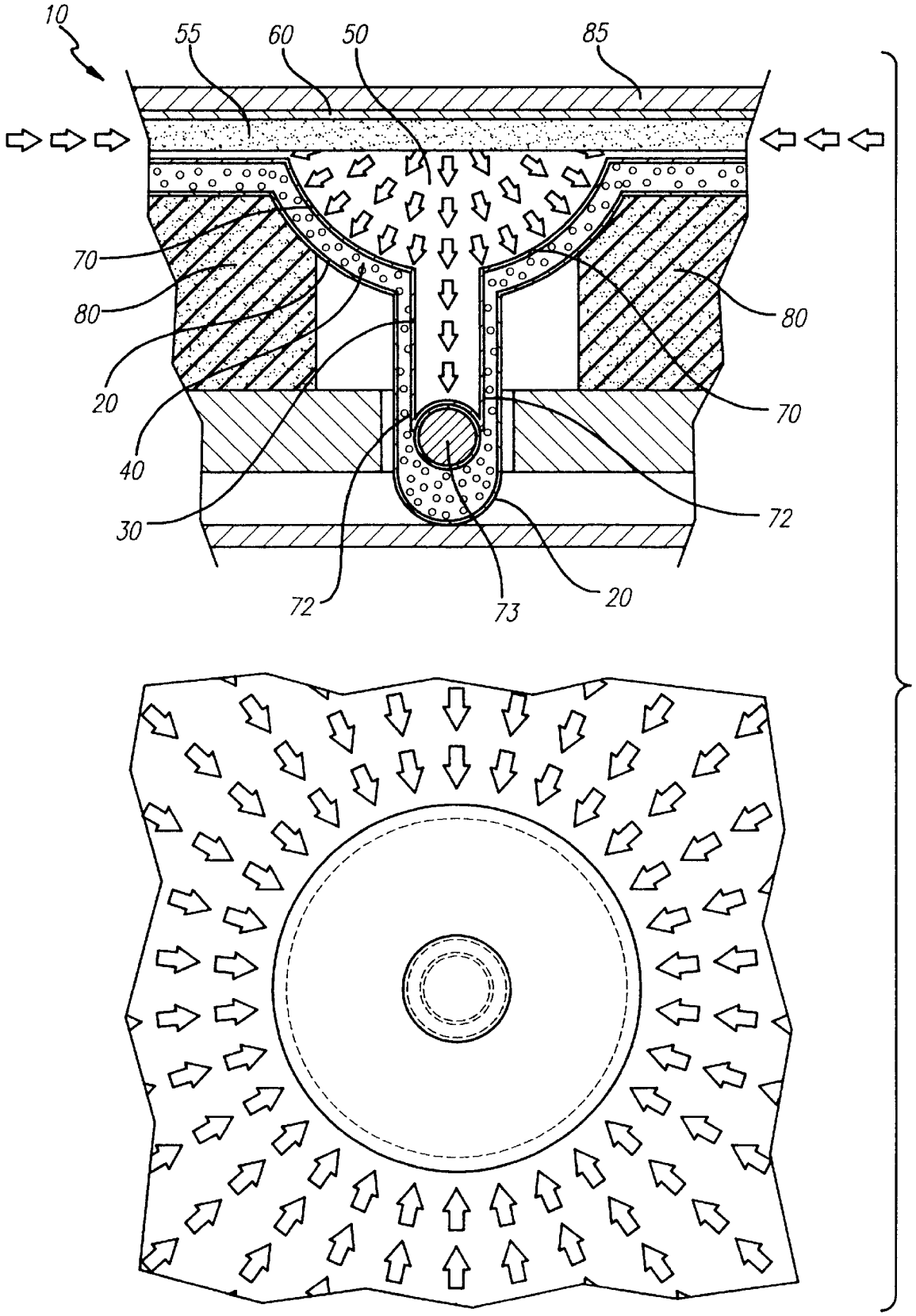
FIG. 4 is a cross sectional detail view showing a non-impacted equalization pocket of the impact resistant helmet shown after a generally adjacent equalization pocket is impacted.

Shown throughout the figures, the present invention is directed towards an impact resistant helmet assembly, generally indicated as 10. The impact resistant helmet assembly 10 is oriented so that it substantially dampens and better distributes the impact of a direct blow to the helmet, and thereby protects a wearer from injury. Moreover, the helmet assembly 10 can be incorporated into a variety of different sizes and exterior configurations to suit a particular wearer and or activity for which such safety gear is necessary.

In particular, the impact resistant helmet assembly 10 of the present invention includes a first material layer 20 coupled to a second material layer 30 so as to define a gas chamber 40 therebetween. In this regard, the first and second material layers 20 and 30 may be directly or indirectly secured with one another, or the first material layer may merely envelope and enclose the second material layer 30, without being directly fastened thereto, to define the gas chamber 40 therebetween. Preferably, each of the material layers 20 and 30 will be constructed of a durable, generally pliable, fluid impervious, resilient material structured to conform to the desired dimensions of the helmet assembly. The gas chamber 40 itself is structured to be filled with a quantity of gas in order to provide some impact dampening. The quantity of gas disposed inside the gas chamber 40, which may include a variety of gases, preferably includes air so as to facilitate construction and adjustment. Specifically, the preferred embodiment of the impact resistant helmet assembly 10 includes gas introduction means 90 structured to permit a user to effectively vary and control the quantity of gas disposed inside the gas chamber 40. As such, a wearer, by adjusting the quantity of gas inside the gas chamber 40, can effectuate a more secure and comfortable fit of the impact resistant helmet assembly 10 on his/her head, thereby improving the impact dampening thereof as well as the comfort. In particular, as can be appreciated, the size and shape of a wearer's head is often not a standard dimension and it is preferred that a generally snug, adjusted fit be maintained for purposes of comfort and such that the impact force is directly translated into the dampening characteristics of the helmet assembly 10 rather than into the wearer should gaps between the helmet and the wearer exist. In the preferred embodiment, the gas introduction means 90 include a valve structure with a re-sealable air inlet/outlet connected to a pump or similar air introduction device. Of course, a simple valve to provide for manual inflation and deflation could also be effectively incorporated. Moreover, it may be preferred to provide a pressure regulation valve capable of automatically adjusting the gas pressure in response to the conditions of use. Furthermore, the gas introduction means 90 can be effectively mounted in any non-obtrusive location on the helmet assembly 10.

The improved impact resistant helmet assembly of the present invention further includes a containment layer 60 disposed over the second material layer 30 and coupled thereto. The containment layer 60, which is also preferably formed of a fluid impervious material, is coupled to the second material layer 30 so as to define a fluid chamber 50 therebetween. The fluid chamber 50 is structured to contain a quantity of fluid therein and is defined by the containment layer 60 and second material layer 30 such that upon an impact to the helmet assembly 10, the fluid at an impacted region of the fluid chamber 50 is disbursed to non-impacted regions of the fluid chamber 50. This disbursement of fluid from the impacted regions of the fluid chamber 50 to the non-impacted regions of the fluid chamber 50 provides substantially enhanced impact distribution and dampening.

In the preferred embodiment of the present invention, the fluid disposed within the fluid chamber 50 includes a generally viscous liquid or a viscous gel. Such a generally viscous liquid or gel is preferred because their physical characteristics provide some added resistance against disbursement from the impacted region of the fluid chamber 50 to the non-impacted region of the fluid chamber 50. Of course, that resistance against disbursement causes a greater amount of the force of impact to be translated into moving the fluid and substantially enhances the impact distribution and dampening of the impact resistant helmet assembly 10. Moreover, to further enhance the impact distribution of the impact resistant helmet assembly 10, a plurality of granular particulate 52 may also be disposed within the fluid chamber 50 and mixed with the fluid. Whether that fluid is the preferred viscous fluid or any conventional liquid, the granular particulate 52, which can be of a variety of dimensions and can be solid or preferably somewhat pliable and substantially light weight, help to further resist the quick disbursement of the fluid within the fluid chamber 50 from the impacted regions of the fluid chamber 50 to the non-impacted regions of the fluid chamber 50 so as to improve the impact distribution and impact dampening effect of the impact resistant helmet assembly 10. Of course, a most preferred characteristic of the granular particulate 52 is that they be light weight so as to not significantly add to the overall weight of the helmet assembly 10. Moreover, it may be preferred to incorporate the granular particulate 52, such as pulverized volcanic rock or another ultra-lightweight granular solid, as this will substantially lower the density of the fluid and will significantly increase the light weight nature of the helmet. In this regard, it is seen that the use of a lower density fluid for impact dampening further serves to maintain the light weight nature of the helmet assembly 10 of the present invention.

As yet another preferred feature of the present invention, the fluid chamber 50 may also include a filter layer 55 disposed therein, as shown in the figures. The filter layer 55 is structured to provide a permeable barrier that further resists disbursement of the fluid from the impacted regions of the fluid chamber 50 to the non-impacted regions of the fluid chamber 50. As such, a greater quantity of an impact force is translated into moving/disbursing the fluid throughout the fluid chamber 50.

Although the containment layer 60 and second material layer 30 may be of a smooth, uniform configuration so as to define a uniform fluid chamber 50, in the preferred embodiment, the fluid chamber 50 is defined so as to include a plurality of equalization pockets 70 disposed therein. The equalization pockets 70 are preferably defined by the second material layer 30 to include a generally conical configuration, as shown in the figures. Furthermore, the generally conical configuration of the equalization pockets 70 is structured so that they extend radially inwardly towards the wearer's head and are preferably defined by the second material layer 30. Of course, separate inserts could also be provided to define the equalization pockets 70. In either instance, it is also preferred, although not necessary, that the first material layer 20 include a configuration corresponding the contours of the equalization pockets 70 such that the gas chamber also extends over the equalization pockets 70.

Looking more specifically to the equalization pockets 70, preferably there are a plurality spaced throughout the helmet assembly 10 so as to be in a variety of potential impact regions. Moreover, the equalization pockets 70 may be particularly concentrated at a vulnerable region of the helmet assembly. The equalization pockets 70 are preferably constructed so as to collapse under the force of an impact. Further, the equalization pockets 70, which may include a variety of geometric configurations, are structured to contain a reservoir of fluid therein which is in fluid flow communication with remaining equalization pockets 70 and a remainder of the fluid chamber 50. As such, when an equalization pocket 70 is compressed under the force of an impact, all of the fluid reservoir contained thereby must be disbursed to a remainder of the fluid chamber 50. Additionally, as the fluid chamber 50 includes a finite volume that is preferably substantially filled with the fluid, the equalization pockets are also preferably structured to expand a certain extend upon fluid from an impacted region being pushed therein such that the increased quantity of fluid can be effectively accepted therein. Moreover, the preferably resilient nature of the equalization pockets 70 functions to generally resist expansion as increased fluid is received, a feature which also functions to dissipate a quantity of the impact force applied to the helmet. Of course, it is still preferred that the filter layer 55 be provided and disposed between the equalization pockets 70 so as to resist against disbursement of the fluid from the equalization pockets 70 at the impacted region of the fluid chamber 50 to equalization pockets 70 at non-impacted regions of the fluid chamber 50 and thereby enhance the impact distribution and dampening effect of the impact resistant helmet assembly 10.

As previously recited, in the preferred embodiment of the helmet assembly 10, the equalization pockets 70 include a generally tapered configuration, such as a generally conical shape. Moreover, the equalization pockets 70 are preferably oriented such that a tip 72 of each of the equalization pockets 70 is directed towards the wearer's head. It is at that tip 72 that the impact force being translated through the fluid actually affects the wearer's head, and given the small surface area and the substantial dissipation of the force which is provided by the remain structure of the helmet assembly 10, that force that affects the wearer's head is relatively minimal. Indeed, it is seen that the present invention is uniquely structured pursuant to Pascal's theories on force distribution, by recognizing that an impact translated through a fluid at a location of small surface area transfers less force to a wearer than an equivalent impact translated at a location of a large surface area. Accordingly, the structure of the present invention, including the positioning and the small surface area of the tip 72 of the equalization pockets 70 tends to concentrate a translated force at the tip 72 and does not allow for a great degree of impact force to be translated therethrough to the wearer's head.

Additionally, in the preferred embodiment, the tip 72 of each of the equalization pockets 70 further includes an anti-deformation element 73. Specifically, the anti-deformation element 73 is structured to promote the uniform compression of the equalization pockets 70 upon an impact, thereby ensuring uniform disbursement of the fluid reservoir. Additionally, the anti-deformation elements 73 are structured to more uniformly distribute the impact force through the tip 72 of each of the equalization pockets 70 disposed at the non-impacted regions. As illustrated in the figures, the impact force is not focused at one point, but rather is spread over the surface of the anti-deformation element 73. In the preferred embodiment, the anti-deformation elements 73 are formed of a generally resilient material, such as polystyrene, which will deform slightly, and have a generally smooth, rounded configuration. As such, the anti-deformation elements 73 will further function to prevent rips or punctures at the tip 72 of the equalization pockets 70, and will prevent collapse of the gas chamber onto the second material layer at the tip 72.

For further comfort and convenience, a resilient material layer 80 is also preferably included and disposed between the first material layer 20 and the wearer's head. This resilient material layer 80 may include one or more layers of foam or another comfortable absorbent material, and preferably lines an interior of the helmet assembly 10. Additionally, a plurality of openings may also be defined in the resilient material layer 80 to correspond the location of the individual equalization pockets 70. As such, the resilient material layer 80 can be provided up to the surface of the first material layer 80 without affecting the orientation and compressibility of the equalization pockets 70. It is further seen that the resilient material layer 80 may be fixed or removable as with conventional helmet designs.

Lastly, a preferred embodiment of the present invention includes a rigid exterior shell 85. The rigid exterior shell 85, which may even be provided as the containment layer, gives the helmet assembly 10 of the present invention an appropriate exterior appearance and configuration, and serves to shield the interior components from potential cuts or impacts.

Since many modifications, variations, and changes in detail can be made to the described preferred embodiment of the invention, it is intended that all matters in the foregoing description and shown in the accompanying drawings be interpreted as illustrative and within the scope and spirit of this invention, and not in a limiting sense. Thus, the scope of the invention should be determined by the appended claims and their legal equivalents. Now that the invention has been described,

What is claimed is:

1. To dampen and resist an impact force applied thereto, an impact resistant helmet assembly comprising:

a first material layer, a second material layer disposed relative to said first material layer so as to define a gas chamber therebetween, a quantity of gas disposed in said gas chamber so as to provide impact dampening, a containment layer structured and disposed to define a fluid chamber, a quantity of fluid disposed in said fluid chamber such that fluid at an impacted region of said fluid chamber is disbursed to non-impacted regions of said fluid chamber so as to provide enhanced impact distribution and dampening, and said fluid including a plurality of granular particulate disposed therein and structured to provide some resistance against disbursement from said impacted region of said fluid chamber to said non-impacted regions of said fluid chamber and thereby further enhance said impact distribution and dampening, and structured to lower a density of said fluid so as to lessen a weight thereof.

2. An impact resistant helmet assembly as recited in claim 1 further including gas introduction means structured to adjustably vary said quantity of gas disposed in said gas chamber so as to vary a secure fit of said first material layer on a wearer's head and said impact dampening of said gas chamber.

3. An impact resistant helmet assembly as recited in claim 2 wherein said gas includes air.

4. An impact resistant helmet assembly as recited in claim 1 wherein said fluid includes a generally viscous fluid structured to provide some resistance against disbursement from said impacted region of said fluid chamber to said non-impacted regions of said fluid chamber and thereby further enhance said impact distribution and dampening.

5. An impact resistant helmet assembly as recited in claim 4 wherein said fluid includes a generally viscous gel.

6. An impact resistant helmet assembly as recited in claim 5 wherein said fluid includes a plurality of granular particulate disposed therein and structured to provide some resistance against disbursement from said impacted region of said fluid chamber to said non-impacted regions of said fluid chamber and thereby further enhance said impact distribution and dampening, and structured to lower a density of said fluid so as to lessen a weight thereof.

7. An impact resistant helmet assembly as recited in claim 6 further including a filter layer disposed in said fluid chamber and structured to provide some resistance against disbursement of said fluid from said impacted region of said fluid chamber to said non-impacted regions of said fluid chamber and thereby further enhance said impact distribution and dampening.

8. An impact resistant helmet assembly as recited in claim 1 further including a filter layer disposed in said fluid chamber and structured to provide some resistance against disbursement of said fluid from said impacted region of said fluid chamber to said non-impacted regions of said fluid chamber and thereby further enhance said impact distribution and dampening.

9. An impact resistant helmet assembly as recited in claim 1 wherein said fluid chamber further includes a plurality of equalization pockets disposed therein, each of said equalization pockets containing a reservoir of said fluid therein and being structured to be compressed upon the impact force being applied so as to urge said reservoir of said fluid within said equalization pockets disposed at said impacted region towards said equalization pockets disposed at said non-impacted regions and thereby provide substantial impact dampening.

10. An impact resistant helmet assembly as recited in claim 9 wherein said equalization pockets at said non-impacted regions are structured to expand so as to receive increased quantities of said fluid therein.

11. An impact resistant helmet assembly as recited in claim 9 further including a filter layer disposed between said plurality of equalization pockets and structured to provide some resistance against disbursement of said fluid from said equalization pockets at said impacted region of said fluid chamber to said equalization pockets at said non-impacted regions of said fluid chamber and thereby further enhance said impact distribution and dampening.

12. An impact resistant helmet assembly as recited in claim 9 wherein said equalization pockets include a generally tapered configuration structured and disposed to contain said reservoir of said fluid and extend radially inwardly towards the wearer's head such the impact force affects the wearer's head at a tip of each of said equalization pockets that includes a generally small surface area and thereby lessens a translated force therethrough.

13. An impact resistant helmet assembly as recited in claim 9 wherein said equalization pockets include an anti-deformation element disposed at a tip of each of said equalization pockets and structured to promote uniform compression of said equalization pockets disposed at said impacted region, to promote impact distribution at said equalization pockets disposed at said non-impacted regions, and to minimize a risk of breakage or ripping to said first and said second material layers.

14. An impact resistant helmet assembly as recited in claim 9 wherein said equalization pockets are defined in said second material layer.

15. An impact resistant helmet assembly as recited in claim 9 wherein said first material layer is structured to include a plurality of recessed regions which correspond and matingly receive said equalization pockets.

16. An impact resistant helmet assembly as recited in claim 9 further including a resilient material layer disposed between said first and second material layers and the wearer's head.

17. An impact resistant helmet assembly as recited in claim 16 wherein said resilient material layer further includes a plurality of openings defined therein and structured to receive said equalization pockets therein such that upon the impact force being directed towards the wearer's head, said equalization pockets at said impacted area are caused to compress.

18. An impact resistant helmet assembly as recited in claim 1 further including a rigid exterior shell.

19. To dampen and resist an impact force applied thereto, an impact resistant helmet assembly comprising:

a first material layer, a second material layer disposed relative to said first material layer so as to define a gas chamber therebetween, a quantity of gas disposed in said gas chamber so as to provide impact dampening, a containment layer coupled to said second material layer and structured to define a fluid chamber therebetween, a quantity of fluid disposed in said fluid chamber such that fluid at an impacted region of said fluid chamber is disbursed to non-impacted regions of said fluid chamber so as to provide enhanced impact distribution and dampening, said fluid including a generally viscous fluid structured to provide some resistance against disbursement from said impacted region of said fluid chamber to said non-impacted regions of said fluid chamber and thereby further enhance said impact distribution and dampening, said fluid chamber further including a plurality of equalization pockets disposed therein, each of said equalization pockets containing a reservoir of said fluid therein and being structured to be compressed upon the impact force being applied so as to urge said reservoir of said fluid within said equalization pockets disposed at said impacted region towards said equalization pockets disposed at said non-impacted regions and thereby provide substantial impact dampening, and said equalization pockets at said non-impacted regions being structured to expand so as to receive increased quantities of said fluid therein.

20. An impact resistant helmet assembly as recited in claim 19 further including a filter layer disposed between said plurality of equalization pockets and structured to provide some resistance against disbursement of said fluid from said equalization pockets at said impacted region of said fluid chamber to said equalization pockets at said non-impacted regions of said fluid chamber and thereby further enhance said impact distribution and dampening.

21. An impact resistant helmet assembly as recited in claim 9 wherein said equalization pockets include a generally tapered configuration structured and disposed to contain said reservoir of said fluid and extend radially inwardly towards the wearer's head such the impact force affects the wearer's head at a tip of each of said equalization pockets that includes a generally small surface area and thereby lessens a translated force therethrough.

22. To dampen and resist an impact force applied thereto, an impact resistant helmet assembly comprising:

a first material layer, a second material layer disposed relative to said first material layer so as to define a gas chamber therebetween, a quantity of gas disposed in said gas chamber so as to provide impact dampening, a containment layer structured and disposed to define a fluid chamber, a quantity of fluid disposed in said fluid chamber such that fluid at an impacted region of said fluid chamber is disbursed to non-impacted regions of said fluid chamber so as to provide enhanced impact distribution and dampening, and at least one equalization pocket disposed in said fluid chamber, said equalization pockets containing a reservoir of said fluid therein and being structured to be compressed upon the impact force being applied so as to urge said reservoir of said fluid within said equalization pocket disposed at said impacted region towards said non-impacted region and thereby provide substantial impact dampening.

* * * * *